US005553149A

United States Patent [19]

Freadman

[11] Patent Number: 5,553,149

[45] Date of Patent: Sep. 3, 1996

[54] THEATER SOUND FOR MULTIMEDIA WORKSTATIONS

[75] Inventor: Tommyca Freadman, Goshen, N.Y.

[73] Assignee: Sparkomatic Corp., Milford, Pa.

[21] Appl. No.: 333,273

[22] Filed: Nov. 2, 1994

[51] Int. Cl.[6] ..... H04R 5/00

[52] U.S. Cl. ..... 381/24; 381/155; 381/90; 181/147

[58] Field of Search ..... ; 381/24, 27, 90, 381/88, 87, 159, 155, 150, 188, 205, 182; 181/199, 148, 144, 145, 147, 153, 154; H04N 5/640

[56] References Cited

U.S. PATENT DOCUMENTS 3,627,948 12/1971 Nichols ..... 381/159
4,764,960 8/1988 Aoki et al. ..... 381/24
5,309,518 5/1994 Ickler et al. ..... 381/24
5,448,647 9/1995 Koizumi ..... 381/24

FOREIGN PATENT DOCUMENTS 3829278 3/1990 Germany ..... H04N 5/640

*Primary Examiner*—Curtis Kuntz
*Assistant Examiner*—Ping W. Lee
*Attorney, Agent, or Firm*—Graham & James LLP

[57] ABSTRACT

A sound reproduction system is disclosed that uses a single pair of compact speaker enclosures to provide surround sound for a multimedia computer workstation. A pair of stereo speaker enclosures provide the computer screen's monaural center channel to a viewer seated at the workstation, as well as pairs of stereo-imaging and stereo surround channels.

9 Claims, 3 Drawing Sheets

THEATER SOUND FOR MULTIMEDIA WORKSTATIONS

BACKGROUND OF THE INVENTION

1. Field of the Invention

The invention is directed to home-theater sound reproduction systems. More particularly, the invention is directed to providing theater-type surround sound for computer workstations.

2. Discussion of Related Art

Speaker systems providing "theater-type" surround sound for video programs are becoming as common in consumers' home entertainment centers as the "music-type" surround sound speaker systems used for audio program material. Both usually employ three or more speakers.

"Music-type" surround sound reproduction systems usually add one or more audio sources, placed behind the listener, to the familiar pair of stereo-imaging channels that are provided to speakers located in front of the listener. A bass channel may also be provided to a non-directional speaker located at any convenient point in the room, usually below eye level.

"Theater-type" surround sound reproduction systems for the video screen in home entertainment centers provides a central monaural channel through one or more speakers close to the video screen. This is supplemented by stereo-imaging channels that are provided to speakers located behind the listener. Again, a bass channel may also be provided to a non-directional speaker located at any convenient point in the room.

Because of the compact size of the video image, this "theater-type" sound reproduction system provides greater auditory realism for the sound accompanying a video program than can be achieved by the orthodox "music-type" stereo imaging used to reproduce the acoustic space of a concert hall. However, such systems are both too bulky and too expensive for use with computer-based desktop multimedia workstations. They also are not suitable for use by an operator sitting at a computer workstation, in that they provide proper sound imaging for a family watching television in the "home-theater" environment, not for the computer workstation environment where the viewer is close to the video screen.

SUMMARY OF THE INVENTION

The present invention provides a sound reproduction system for a computer workstation having a video screen. The system comprises two complementary speaker enclosures adapted to be placed in front of the line of sight of a viewer using the video screen. Each speaker enclosure has a center-channel speaker opening and a surround-channel speaker opening.

The respective center-channel speaker openings each define a plane such that axes in the center of the respective openings that are orthogonal to said plane intersect near the viewer's location in front of the video screen and near the viewer's eye-level when the enclosures are placed near each side of the video screen. When the enclosures are placed in this manner, near each side of the video screen, the surround-channel speaker opening in each enclosure defines a plane such that axes in the center of the respective openings that are orthogonal to said plane intersect at a point behind the video screen from the viewer's location and above the viewer's eye-level.

In a preferred embodiment, a pair of stereo-imaging channels are also provided in each enclosure. In a particular embodiment, these channels are advantageously provided through a crossover net to a pair of front-channel speakers in each enclosure, to permit greater dynamic range within the space constraints of a compact, multi-channel speaker enclosure.

BRIEF DESCRIPTION OF THE DRAWINGS

The invention will be better understood when the description of a preferred embodiment given below is considered in conjunction with the drawings provided, wherein.

In these drawings, like items have like reference numerals.

DETAILED DESCRIPTION OF THE PREFERRED EMBODIMENT

Figure 1:
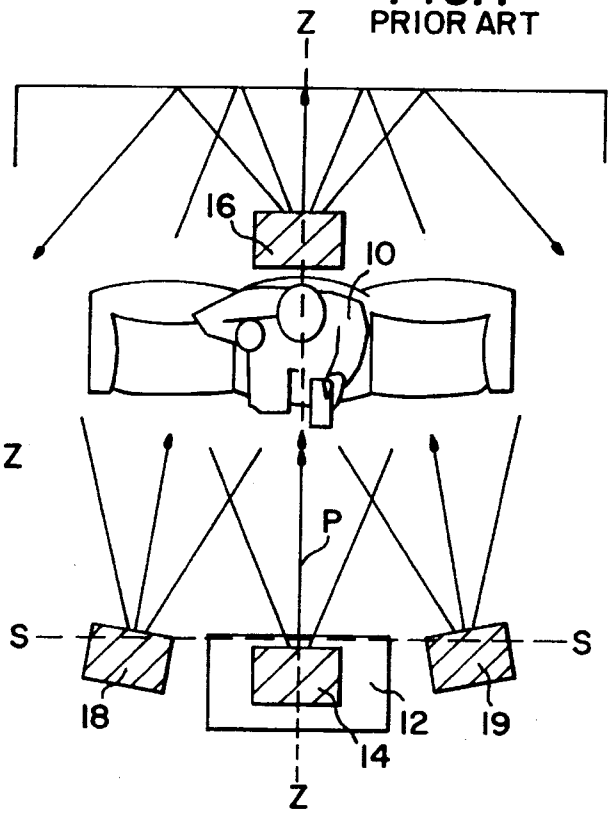
FIG. 1 PRIOR ART
FIG. 1 is a schematic plan view of a prior art theatrical sound system for in-home multimedia presentations.

With reference to FIG. 1, prior art "home theater" speaker systems are designed to provide realistic sound reproduction for a video audience 10 comprising the members of a medium-size family group. Video screens 12 suitable for audiences 10 of this size are generally at least 20" on the diagonal and are designed to be viewed at a distance of 5 feet or more, a much greater than the distance between a viewer and the video screen at a computer workstation.

To provide realistic sound distribution for a video audience 10 of this type, a monaural center channel 14 is usually provided immediately above and/or below the center of the video screen 12, in the substantially the same plane "s" as the video screen 12. This prevents a side-wise dislocation of the apparent audio source relative to the screen 12, for viewers seated off-center relative to the viewing axis "z" perpendicular to the plane "s" of the screen 12. The viewing axis "z" is in the same vertical plane as the principal axis "p" of that center-channel speaker 14.

In popular, compact home theater systems, stereo information is supplied indirectly through a centrally-located pair of divergent speakers (not shown) in a single enclosure located along the viewing axis, behind the audience 10. An optional box (not shown) providing non-directional bass reinforcement is sometimes added. This bass box might be tucked under the couch itself or a table somewhere else in the room, usually on the floor.

In the Dolby Prologic™ home theater sound system, the surround sound channel is monaural and provided through a rear speaker enclosure 16. Stereo sound is provided by speakers 18, 19 on either side of the center channel speaker 14.

Figure 2:
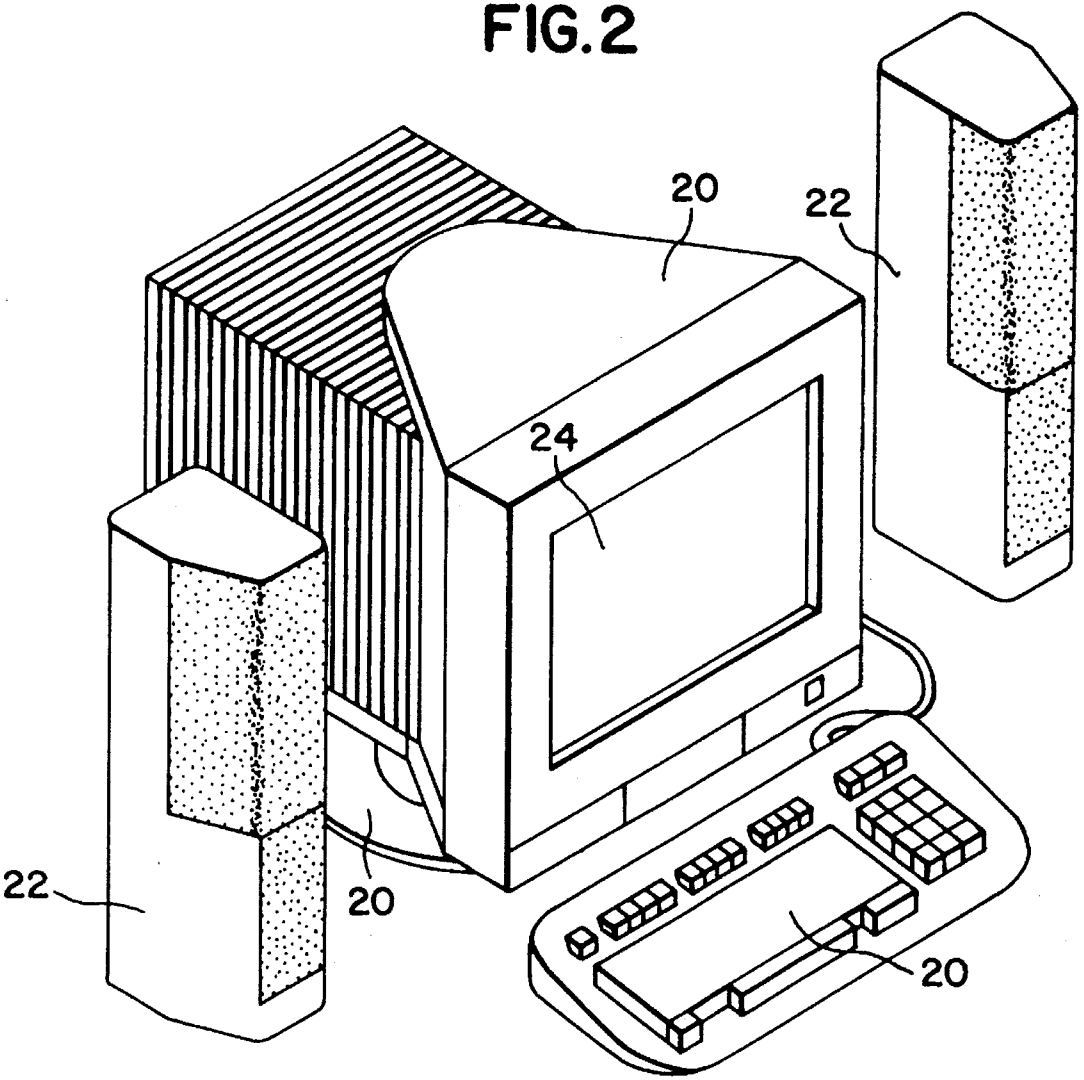
FIG. 2 is a perspective view of a system in accordance with the present invention.

In contrast, all speakers for the video workstation 20 in FIG. 2 are provided by a pair of speaker towers 22 on either side of the video screen 24, that provide three channels to the viewer 26 through a total of eight speakers that are enclosed by the towers in this system. The towers 22 are designed to provide a symmetrical pair of center-channel speakers 28 at the center of the screen, the nominal eye-level "x" of a viewer 26 seated comfortably at the workstation, when the towers 22 are placed directly on the table that supports the video workstation 20.

Figure 4:
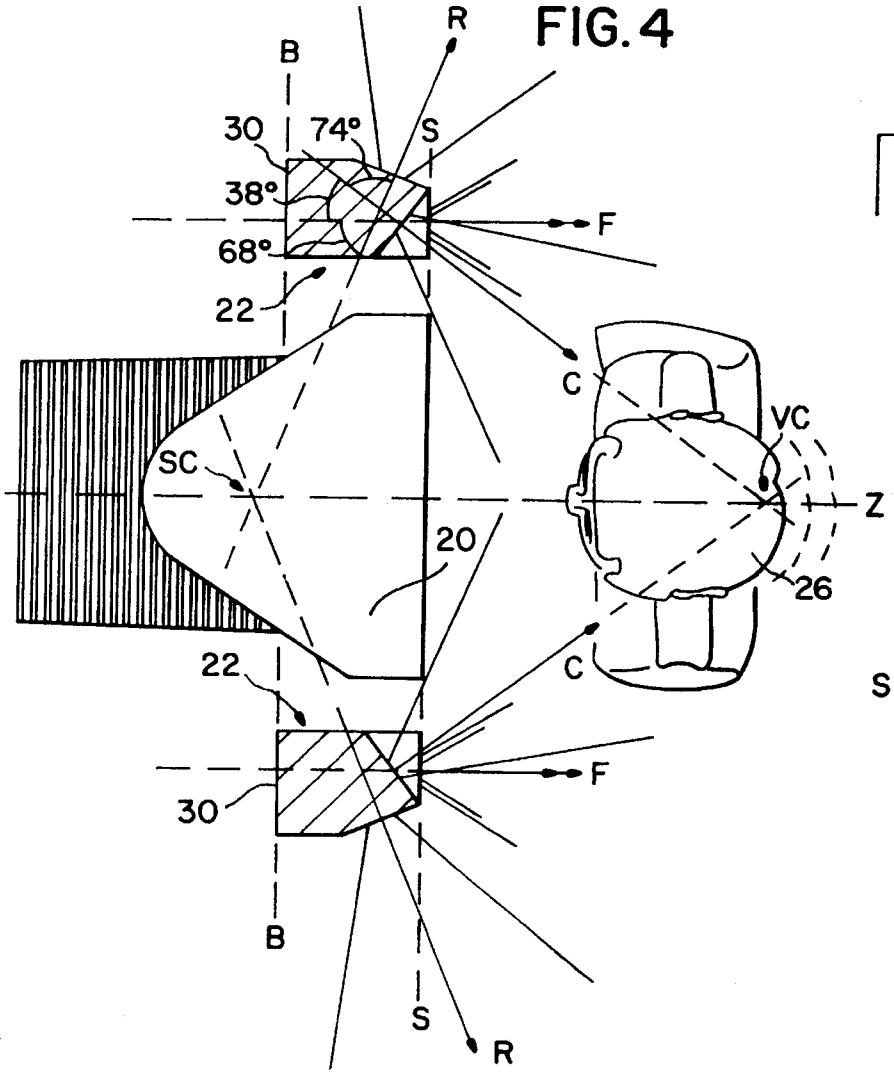
FIG. 4 is a plan view of the system of FIG. 2.
Figure 3:
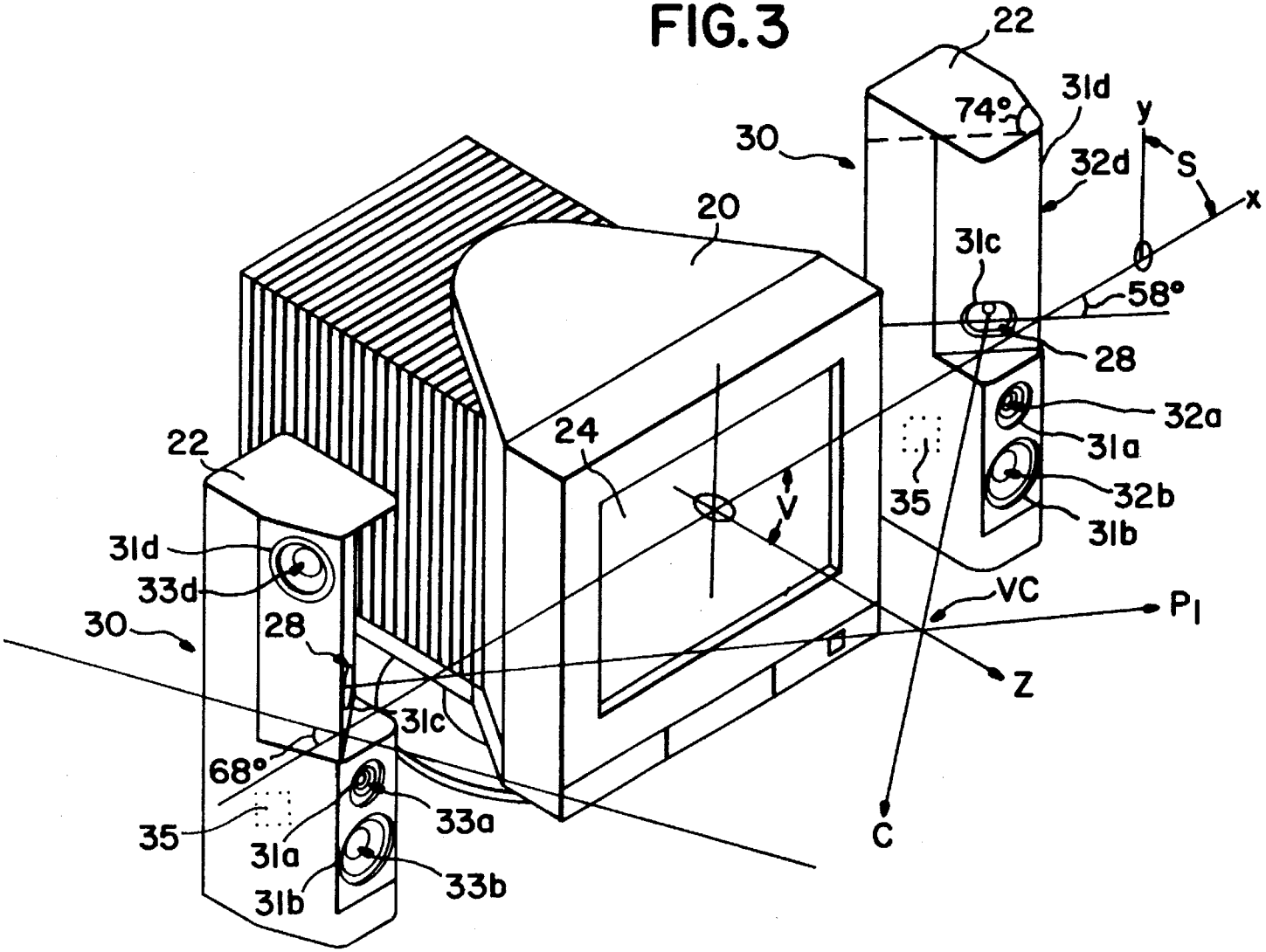
FIG. 3 shows the system of FIG. 2 with grill cloth removed from the enclosures.

Preferrably, the towers are 458.0 mm high, 113.5 mm wide and 163.5 mm deep. In FIGS. 2 through 4, the towers 22 are placed so that a plane including the back plane 30 of each enclosure 22 is parallel to the screen plane "s". Also, the respective front-channel openings 31*a*, 31*b* lie in planes that are co-planar with the screen plane "s" and perpendicular to the major axis of the sound provided by each of the front-channel speakers 32*a*, 32*b*, 33*a*, 33*b*. Preferrably the centerlines "f" for the front-channel speakers in each tower 22 are 60 to 100 cm apart in the screen plane "s".

The center-channel openings 31*c*, however, lie in planes that are rotated about a vertical axis from a plane that is parallel to the screen plane "s". Preferrably, these planes form a 38-degree angle with the screen plane "s" in the viewing plane "v" so that the major axes $P_2$, $P_1$of the sound distribution provided by the center-channel speakers 32*c*, 33*c* intersect at a point "vc" within the area occupied by the viewer's head. In this embodiment, the major axes of all the speakers are perpendicular to the plane defined by the speaker opening.

Likewise, the surround channel openings 31*d*, lie in planes that are rotated about a vertical axis from a plane parallel to the screen plane "s". Preferrably, these planes form a 68-degree angle with the screen plane "s" in the viewing plane "v" so that the major axes of the sound distribution provided by the surround-channel speakers 32*d*, 33*d* intersect at a point "sc" behind the video screen 24.

The front-channel speakers 32*a* 32*b*, 33*a*, 33*b* in these towers may be provided with respective standard right (32) or left (33) recorded audio, or synthesized stereo program material. In a preferred embodiment the tweeters 32*a*, 33*a* provide frequencies from 3.5 to 20 kHz, and the mid-range speakers 32*b*, 33*b* provide frequencies from 80 Hz to 3.5 kHz through a crossover network 35, shown in phantom in FIG. 3.

The center-channel speakers may receive a monaural mix of the stereo material or recorded center-channel audio. The surround-channel speakers receive a respective synthetic copy of the stereo material provided for each side of the room, or respective recorded rear-channel audio.

Preferrably, audio is provided to the five channels in this system using a multi-channel format such as Dolby Prologic™ four-channel encoding. In such formats, the center channel is generally a monaural mix of right and left stereo channels in the range of 100 Hz–15 kHz, with the off-center, phase-shifted information therein attenuated. The information supplied to the surround channel is 100 Hz to 7.5 kHz information delayed 20-30 msec relative to the center channel.

In the preferred embodiment, the single Dolby Prologic™ "center" channel is supplied to both center-channel speakers 28, so as to produce an acoustic image that is centered on the viewing screen 24. Similarly, the single Dolby Prologic™ "surround" channel is supplied to both surround-channel speakers 32*d*, 33*d*. However, the surround channel information provided to the two speakers is modified so that the two speakers are 180-degrees out-of-phase with each other.

The peculiar interaction of this out-of-phase surround channel information directed away from the viewer in accordance with the present invention with the right and left front channels that are directed to either side of the viewer in accordance with the present invention, has the auditory effect of displacing the sound image provided by the surround-channel speakers 32*d*, 33*d* from behind the workstation 20 to a different apparent location beside or slightly behind the viewer 26. Thus, realistic center-channel and surround-channel sound can be added to the stereo sound provided at a multimedia workstation without adding other speaker enclosures.

It will be appreciated by one skilled in the art that variations and modifications are possible within the spirit and scope of the present invention. For example, multiple speakers may be used for any of the channels in these two speaker enclosures or a non-directional bass box might be added to the system for use with some types of video program material. The embodiment described above illustrates a presently preferred construction and use of the invention defined by the claims enumerated below.

I claim:

1. A speaker enclosure for providing theater sound for an audio-visual system when placed as one of a pair of enclosures on either side of a viewing screen connected to display visual output to a viewer using the system, said enclosure comprising:

a front-channel speaker opening defining a front-channel plane;

a center-channel speaker opening defining a center-channel plane that is rotated toward the screen so as to form a 38-degree angle with said front-channel plane; and a surround-channel speaker opening defining a surround-channel plane that is rotated away from the screen so as to form a 68-degree angle with said front-channel plane and a 74-degree angle with said center-channel plane.

2. The speaker enclosure of claim 1 further comprising:

a center-channel speaker adapted to provide 100 Hz to 15 kHz information;

a front-channel speaker adapted to provide 80 Hz to 20 kHz information; and a surround-channel speaker adapted to provide 100 Hz to 7.5 kHz information.

3. The speaker enclosure of claim 2 wherein said front-channel speaker comprises a first speaker providing 3.5 kHz to 20 kHz information and a second speaker providing 80Hz to 3.5 kHz information.

4. The speaker enclosure of claim 3 wherein the information provided to said first and second speakers is derived by a cross-over network.

5. The speaker enclosure of claim 2 wherein the major axis of the sound produced by the respective speakers is perpendicular to the respective speaker planes.

6. The speaker enclosure of claim 1 further comprising:

a center-channel speaker adapted to provide center channel information;

a front-channel speaker adapted to provide left or right stereo information; and a surround-channel speaker adapted to provide information delayed 20 to 30 msec behind the center channel information.

7. A speaker enclosure for providing theater-type sound for an audio-visual system when placed as one of a pair of enclosures placed on either side of a viewing screen connected to display visual output to a viewer using the system, said enclosure comprising:

a front-channel speaker having a major axis of the sound produced by said speaker that is perpendicular to a front-channel plane;

a center-channel speaker having a major axis of the sound produced by said speaker that is perpendicular to a center-channel plane that is rotated toward the screen so as to form a 38-degree angle with said front-channel plane; and a surround-channel speaker having a major axis of the sound produced by said speaker that is perpendicular to a surround-channel plane that is rotated away from the screen so as to form a 68-degree angle with said front-channel plane and a 74-degree angle with said center-channel plane.

8. A sound reproduction system having right and left mirror-image speaker enclosures adapted to be placed on either side of a viewing screen, said enclosures comprising:

a front-channel speaker opening defining a front-channel plane;

a center-channel speaker opening defining a center-channel plane that is rotated toward the screen so as to form a 38-degree angle with said front-channel plane; and a surround-channel speaker opening defining a surround-channel plane that is rotated away from the screen so as to form a 68-degree angle with said front-channel plane and a 74-degree angle with said center-channel plane.

9. A sound reproduction system having right and left mirror-image speaker enclosures for providing theater-type sound for an audiovisual system when placed on either side of a viewing screen connected to display visual output to a viewer using the system, said enclosures comprising:

a front-channel speaker having a major axis of the sound produced by said speaker that is perpendicular to a front-channel plane;

a center-channel speaker having a major axis of the sound produced by said speaker that is perpendicular to a center-channel plane that is rotated toward the screen so as to form a 38-degree angle with said front-channel plane; and a surround-channel speaker having a major axis of the sound produced by said speaker that is perpendicular to a surround-channel plane that is rotated away from the screen so as to form a 68-degree angle with said front-channel plane and a 74-degree angle with said center-channel plane.

* * * * *